US011179583B2

(12) United States Patent
Lucanik

(10) Patent No.: US 11,179,583 B2
(45) Date of Patent: Nov. 23, 2021

(54) FIREFIGHTING WATER GARMENT

(71) Applicant: Adam Lucanik, Horni Bucice (CZ)

(72) Inventor: Adam Lucanik, Horni Bucice (CZ)

( * ) Notice: Subject to any disclaimer, the term of this patent is extended or adjusted under 35 U.S.C. 154(b) by 0 days.

(21) Appl. No.: 16/956,496

(22) PCT Filed: Dec. 18, 2018

(86) PCT No.: PCT/IB2018/060234
§ 371 (c)(1),
(2) Date: Jun. 19, 2020

(87) PCT Pub. No.: WO2019/123236
PCT Pub. Date: Jun. 27, 2019

(65) Prior Publication Data

US 2020/0368562 A1 Nov. 26, 2020

(30) Foreign Application Priority Data

Dec. 19, 2017 (CZ) ..... 2017-817

(51) Int. Cl.

| | |
|---|---|
| ***A62B 17/00*** | (2006.01) |
| ***A41D 31/08*** | (2019.01) |
| ***D03D 15/513*** | (2021.01) |
| *A41D 13/00* | (2006.01) |

(52) U.S. Cl.
CPC ..... *A62B 17/003* (2013.01); *A41D 31/085* (2019.02); *D03D 15/513* (2021.01)

(58) Field of Classification Search
CPC .... A62B 17/003; A62B 17/08; D03D 15/513; A41D 31/085
See application file for complete search history.

(56) References Cited

U.S. PATENT DOCUMENTS

| | | | | |
|---|---|---|---|---|
| 2,648,641 A | | 8/1953 | Robison et al. | |
| 3,955,987 A | * | 5/1976 | Schaar | C09D 5/185 106/18.15 |
| 4,216,261 A | * | 8/1980 | Dias | C09D 5/185 106/18.13 |

(Continued)

FOREIGN PATENT DOCUMENTS

| | | |
|---|---|---|
| CN | 202961583 U | 6/2013 |
| CN | 203736751 U | 7/2014 |

(Continued)

*Primary Examiner* — Robert H Muromoto, Jr.
(74) *Attorney, Agent, or Firm* — Cionca IP Law P.C.; Marin Cionca

(57) ABSTRACT

A firefighting water garment consists of a reinforced cotton fabric with combing manufactured through weaving of doubled yarn with loose end with an area weight approximately 346 g/m2 which is able to absorb up to six-times more liquid than it weights. The fabric is soaked with a water solution that consists of 50% of water, at least, of 2.7 to 50% of extinguishing agent and of 1 to 10% of a component reflecting heat radiation. Another necessary component is powder titanium dioxide which reflects heat radiation perfectly. Evaporation of water from the suit occurs under presence of fire, and the water starts to cool surface of the fabric and thus prevents overheating of the organism. This way marked extension of time for suit exposure in the fire and prevention of rise of dangerous burns on skin is achieved.

16 Claims, 8 Drawing Sheets

| Burn Injury Prediction (according to ISO 13506: 2008 clause 9.5.3) | | | | |
|---|---|---|---|---|
| Pain | 1st° Burn | 2nd° Burn | 3rd° Burn | 2nd° + 3rd° Burn |
| 22.8% | 2.6% | 14.9% | 7.9% | 22.8% |

(56) References Cited

U.S. PATENT DOCUMENTS 4,908,260 A * 3/1990 Dodia ..... B32B 25/04 428/215
5,104,735 A * 4/1992 Cioffi ..... C08K 3/34 174/110 AR
5,723,515 A * 3/1998 Gottfried ..... C09K 21/14 523/179
7,247,374 B2 * 7/2007 Haggquist ..... B01D 53/02 428/403
8,003,555 B2 * 8/2011 Tanaka ..... D01D 10/02 442/414
8,703,853 B2 * 4/2014 Kasowski ..... C07F 9/02 524/148
10,000,663 B1 * 6/2018 Jammer ..... C09D 179/04
10,160,184 B2 * 12/2018 Conolly ..... B32B 15/04
2006/0147698 A1 * 7/2006 Carroll ..... B32B 5/18 428/316.6
2008/0050452 A1 * 2/2008 Chen ..... A61P 17/00 424/618
2008/0276357 A1 * 11/2008 Sigmon ..... A62B 17/003 2/458
2010/0009583 A1 * 1/2010 Bringley ..... D06M 15/295 442/80
2010/0029156 A1 * 2/2010 Tanaka ..... D02G 3/443 442/136
2012/0282490 A1 * 11/2012 Kasowski ..... C09K 21/12 428/704
2013/0212789 A1 * 8/2013 Conolly ..... B32B 27/40 2/458
2013/0341575 A1 * 12/2013 Kasowski ..... C09K 21/12 252/601
2015/0071978 A1 * 3/2015 Chang ..... A61N 2/06 424/402
2015/0140047 A1 * 5/2015 Greenwald ..... D06M 10/06 424/401
2016/0045841 A1 * 2/2016 Kaplan ..... B01D 3/06 429/49
2019/0136415 A1 * 5/2019 Chen ..... A41D 31/0005

FOREIGN PATENT DOCUMENTS

CZ 28742 U1 11/2015
CZ 2015352 A3 2/2017
WO WO-2016189396 A2 * 12/2016 ..... A62B 17/003

* cited by examiner

| Burn Injury Prediction (according to ISO 13506: 2008 clause 9.5.3) | | | | |
|---|---|---|---|---|
| Pain | 1st° Burn | 2nd° Burn | 3rd° Burn | 2nd° + 3rd° Burn |
| 22.8% | 2.6% | 14.9% | 7.9% | 22.8% |

FIREFIGHTING WATER GARMENT

FIELD OF APPLICATION

Protection of persons and animals in case of fire

STATE OF THE ART

We can meet fire anywhere, whether at home, in public spaces or at work. When a fire breaks out people are surrounded by flames and they have to wait till firemen extinguish the fire so people in the affected area can escape into safety. Often, however, people are absorbed by fire as the time to save life is cut down to minutes in case of a large-scale fire. For the time being there is no means on the market to help people and animals flee through flames without dangerous burn which is incompatible with life, from the affected place. The firemen's task is not easy, they must often rush into flames in thin suits and risk their own lives to save lives of other people. The firemen can have professional suits but these are not available for the wide public. The professional suits, however, are able to withstand direct contact with fire for several seconds.

Also firefighting wraps and veils are marketed, they serve as accessories in cars or households. A fire is extinguished when a veil is thrown over. Document CN2014225514U describes a wrap produced of wool that contains glass fibres and an aluminium layer, and all the layers are interconnected with carbon fibres. The wrap is packed in a plastic box and its temperature resilience is up to 550° C. Document CN20122662345U describes a wrap absorbing toxic gasses, which is created of a porous silicone layer which absorbs harmful smog. The suit in patent application US 2008/0276357 consists of a whole-body overall that is covered with an aluminium layer. It is wrapped in such a way to be available also for people in homes or at work. It is only able to withstand environment affected by fire for several seconds, and the aluminium foil serves as protection against flames and heat. Moreover, it is not easy and quick to dress such a suit.

Water is the most famous and the most used substance able to extinguish fire. Water absorbs heat from ambient and evaporates. Most extinguishing means consist to the large part of water. Another necessary component is an extinguishing agent. Many extinguishing agents are marketed, and they can be classified according to their state as solid or liquid ones. The liquid ones can form foam that prevents access of air quickly. Foam compounds can be protein, synthetic, fluoroprotein or generating water gas. The foam compounds most frequently used in extinguishing means come from this group: AFFF (aqueous film foam forming), AFFF/AR (aqueous film foam forming/alcohol resistant). The most frequently used representatives of these groups are the following: synthetic foam compound F-15, Pyrocom, Karate or extinguishing agent FireAde.

Coat containing titanium dioxide is used for protection of property and valuable things. Titanium dioxide reflects radiation due to its high opacity. Its application has been described in document U.S. Pat. No. 2,648,641. Materials like wood or fabric are covered with an intumescent layer which consists of water, resin, amido-compound, titanium dioxide and the like. The layer inflates in contact with fire and prevents access of air. The U.S. Pat. No. 3,955,987 document has described intumescent coat applicable on roofs, tanks, carpets and the like. The coat consists of dry powder mixed in water. The base of the powder is monoamonium phosphate, carbamide, diamonium phosphate and titanium dioxide. Water only serves here in the function of a solvent and/or as a carrier of other substances and it is not present in contact with fire in the substance because the coat is dried subsequently.

Patent application PV 2015-352 and utility patent CZ 28742 have described a firefighting suit that consists of cotton fabric with combing that has been soaked with a soaking agent, and that agent is a solution of an extinguishing agent, of water and of titanium dioxide in ratio up to 99 weight parts of the extinguishing agent, of up to 90 weight parts of water and up to 90 weight parts of titanium dioxide. The drawback of that solution is that it is not possible to implement it in the scope as it has been described and the variability of mutual ratios of the components. Although the documents describe very wide range of combinations of components used it is not clear how the ranges should be moved to achieve the required solution, and moreover an actually functional solution based on combination of ranges of parameters. For example, the condition of 90 weight parts of titanium dioxide is not workable because no solution containing 90% of powder can be soaked in the fabric as this is neither solution nor suspension.

The fabrics are manufactured through weaving on a weaving loom. The weaving principle is based on mutual weaving of two perpendicular systems of threads (warp and weft). The warp lies along the fabric length, while weft across the fabric. A weaving loom consists of a warp beam, on which a large quantity of warp ends is wound and they form so called basic state. A reed with wires is attached to a batten of a weaving loom, and warp ends pass between them. The number of wires per 10 cm gives the reed number. There are heddles in front of the reed, and the heddles are rod-like parts with eyes, through which the warp end is guided. The heddles control movement of warp ends up and down and forms a so called shed, and the shed is a wedge-like gap between two rows of warp ends formed in such a way that some threads of the warp are moved up. Picking motion guides a filling pick the shed. After pick the shed is closed and the reed moves forwards, and thus it battens the inserted weft to the fabric to be created. Then the reed returns and other warp ends are shifted up and pick of the weft is repeated. The way how warp and weft are interlinked forms weave—structure of the fabric.

NATURE OF THE INVENTION

A firefighting water garment has been developed, the composition of which provides for active cooling effect when exposed to fire and which changes its parameters during action of heat caused by fire. The firefighting water garment insulates from direct fire with up to 3 mm wide water wall and at the same time with a heat shield of titanium dioxide of zinc oxide, and they separate the covered person or animal or object from the action of fire. In case of fire of a house or generally a building, when the fire reaches temperature of 600 to 800° C., the firefighting water garment provides its insulation properties for up to 15 minutes, and this is time enough for evacuation into safety. The firefighting water garment has been subjected to intensive test Fireman, where it was dressed on a dummy with 135 temperature sensors and burned with 12 burners where the thermal exposure was at the level of 86 $kW/m^2$. The result of analysis has reported that neither feeling of pain nor first degree burns have occurred for 8 seconds of this intensive action of fire. The detailed results are presented in Example 5. In the exterior, when a fire is well oxidized and temperature of flame is about 1100° C., the firefighting water garment keeps its insulation properties for up to 90 seconds.

This effect is provided through a combined action of cotton fabric, soaking agent, water and titanium dioxide, or possibly of zinc oxide and their ratios.

When ambient heat from a fire is present, water in the firefighting water garment starts to evaporate and it heats to some 70° C. Evaporation draws out thermal energy necessary for transformation of water into vapour, so called adiabatic cooling occurs and the temperature does not rise. The temperature on the inner side of the garment keeps constant and the evaporation process prevents its further increase for the whole time. The present titanium dioxide or zinc oxide act as a thermal shield for reflect heat radiation. The organism is not overheated during evaporation of water and this prevents rise of dangerous burns on skin. The action of the firefighting water garment ceases on evaporation of all water from the fabric and drying of the fabric.

In the ambient proximity of a man in a firefighting suit exposed to fire, huge quantity of heat 2257 kJ/kg is consumed for transformation of water in vapour. Approximately 1700 l of water vapour is generated from a single litre of water at 100° C. At 250° C. it is 2400 l of water vapour and at 650° C. it is unbelievable 4200 l of water vapour. So heat is drawn out from open fire and, at the same time, it is damped by water vapour which limits oxidization of the fire, in the proximity of the water garment.

The effect above occurs in a contact of the firefighting water garment with fire according to both qualitative and quantitative combinations of several essential factors and parameters of the components used:

1. cotton fabric—specific area weight and specific surface of the fabric—100 to 500 g/m$^2$, convenient if 330 to 370 g/m$^2$
2. solution for the firefighting water garment containing
   a) water—50%, at least
   b) soaking agent—its quantity—10 to 50%
   c) titanium dioxide or zinc oxide—its quantity—thixotropy—1 to 10%
3. soaking level—300 ml, at least, for each 1 m$^2$ of cotton fabric, convenient if 1 litre of the solution for a firefighting water garment, more convenient if 2 litres.

These parameters only operate for using the firefighting water garment in a real environment where water is subjected to gravitation and it is necessary both to keep it in the fabric using 10%, at least, of present soaking agent, and to fix it with 1 to 10% of titanium dioxide. In laboratory conditions, parameters other than the real situation were evaluated as best when using the whole suit when water flows through gravity.

Thus the firefighting water garment is produced of cotton fabric with area weight 300 to 400 g/m$^2$ that has been soaked with 1 litre of solution per each 1 m$^2$ for the firefighting water garment which contains 50% of water, at least, 2.7 to 50% of soaking agent and 1 to 10% of titanium dioxide or zinc oxide.

It is convenient if the cotton fabric has been soaked with 2 litres of solution per each 1 m$^2$ for the firefighting water garment, and there is 4 to 6 weight % of titanium dioxide or zinc oxide in the solution.

Explanation of the effect of the parameters on function of the whole system of the firefighting water garment:

Cotton fabric—does not roast and does not decrease its volume in contact with fire. It is woven of 100% cotton and convenient if it is picked subsequently. It has area weight 100 to 500 g/m$^2$, convenient if 300 to 400 g/m$^2$ with high absorption capacity of fluid per unit of surface which is able to absorb up to 7.5 times more fluid, measured by weight.

Water—cooling means which will provide for cooling of ambient temperature on surface of the firefighting water garment, namely for such a long period till the water is present. Water will absorb heat from environment and evaporate which will prevent excessive heating of cotton fabric surface and generated vapour will damp ambient fire.

Soaking agent—substance decreasing surface tension of water to decrease size of water drops and this way it facilitates their permeation in fabric fibres. Any soaking agent can be used, convenient if it is an extinguishing agent or surfactant soluble in water. The soaking agent portion in the solution for the firefighting water garment is 2.7 to 50 weight %. Further increase of the soaking agent share is not efficient, it does not decrease surface tension of water any more, and on the other hand it decreases the share of water which meet its cooling function through evaporation. Practical soaking agents that froth water and prevent air access:

Protein foam compounds generating water film

FFFR/AR (film forming fluoroprotein/alcohol resistant)—protein foam compounds generating water film and also resistant against action of polar fluids S—synthetic multipurpose foam compounds AFFF/AR (aqueous film foam forming/alcohol resistant)—foam compounds generating water film and also resistant against action of polar fluids Surfactants, dish-washing substances Some types of commercial products that can be used: extinguishing agent Pyrocom AFFF, synthetic foam compound F-15, A3F, Karate, PYR, Hilfoam, FM 200, extinguishing agent FireAde, FireAde 2000, FM 200, Fluor-Schaumgeist, Moussol, Sthamex, FOMTEC, Jar[1].

[1] Jar is a Czech brand of household detergent

Water+Soaking Agent

Water itself has high surface tension (73 mN·m$^{-1}$), it does not enter cotton fabric, because of its high area weight given by dense weaving and subsequent combing, and thus water is mixed with a soaking agent. This will cause that its surface tension decreases down to 20 mN·m$^{-1}$. Due to this very small water droplets form, they create a continuous thin layer of water (water film) and also run well into the cotton fabric structure. Tests on wettability have been performed and they have documented cotton fabric significant difference in quantity of soaked pure water against mixture of water and soaking agent per unit of area. The quantity of soaked pure water is only 13 to 20% of mixture of water and soaking agent, as documented in Example 4. Mixture of water and Jar has increased absorption of water into fabric 5 times and mixture of water and extinguishing agent has increased absorption of water into fabric 7.5 times. 1 m$^2$ cotton fabric can soak 2 litres of solution treated with soaking agent.

Titanium dioxide—thermal shield, for reflection of infrared heat radiation. Titanium dioxide or zinc oxide in the firefighting water garment acts as a thermal shield which reflects heat off the fabric surface. And moreover, with water it forms a thixotropic system which prevents water running down because of gravitation and the total quantity that the firefighting water garment is able to contain will increase further.

It is convenient if cotton fabric is produced through doubled weaving and then it is combed. It is convenient if two layers of fabric are sewn one to another. Due to the combing and the weaving technique the fabric has high area weight and high absorption capacity able to contain high quantity of fluid. For example, dry fabric used for production of a single suit weights 1100 g, and is able to soak approximately unbelievable 6 litres of fluid. It is convenient if the weaving technique is set in the weaving loom in such a way that two warp ends are guided into a gap between two rows of wires, and two threads can be guided into a single heddle as well. A filling pick is picked into the shed mechanically, for example using pneumatic pick and it is convenient if two filling picks are picked together. When using this doubled method, when two filling picks are picked between pairs of warp ends, the fabric is manufactured of double yarn with loose end, or the fabric is only manufactured with doubled warp end or with doubled filling pick.

It is convenient if a suit for personal protection or a firefighting veil suitable in cars and households is sewn from a cotton fabric. It is convenient if the suit is sewn in the universal size which fits to persons of various body dimensions. For quick dressing, the suit has been designed like a frock with a hood and velcro strips for quick zipping. The veil can be sewn in various sizes, it is convenient if its size is 150×170 cm. It is convenient if handles are sewn in one side of the veil, they serve for a person to escape from the fire with the veil thrown over to catch the veil.

Any water soluble soaking agent that decreases surface tension of water, for example both extinguishing agents and tensides, surfactants can be used. In our case it was convenient to use water soluble extinguishing agent selected among AFFF foam compounds, FireAde 2000, Fomtec, FM 200 and Jar was used as surfactant. We used 2.7 to 50% of soaking agent, and we used 50% of water, at least, according to efficiency of soaking agent and according to the requirement to utilise secondary properties of soaking agents and of water. A component reflecting heat radiation is added into the generated solution of water and extinguishing agent, it is convenient if titanium dioxide or zinc oxide in range 1 to 10% is used. The firefighting water garment has several levels of application: 1) with the highest cooling effect for civilians, 2) with lower cooling effect for professional firemen and 3) with the lowest cooling effect for things. In case of using the firefighting water garment ad 1), it is convenient if it is in a form of a frock for civilians, then it is desirable so that ambient high heat would not enter under it, to the skin of a person, which would harm his/her health. Therefore it is convenient if the solution for the firefighting water garment is mixed in volume ratio 1:3, thus 1 part of extinguishing agent and 3 parts of water and subsequent addition of 10 weight % of titanium dioxide. This way manufactured firefighting water garment will keep temperature about 70° C. for approximately 90 seconds, at the other side then the fire, usually on the body, under temperature of flames 1100° C. The temperature under the suit keeps constant for approximately 1 minute and generally the temperature rises after 90 seconds depending on how quickly water evaporates from the solution. This situation for example can occur in a case of open fire in bush or generally in nature. In case of fire of a house or another building, when the fire reaches temperature 600 to 800° C., this firefighting water garment keeps its insulation properties for the period up to 15 minutes.

It is convenient if the suits for professional firemen are soaked with a solution where a lesser portion of extinguishing agent and a bigger portion of water are present. It is convenient if their suits are soaked with a solution with the following composition: 85% water, 10% soaking agent and 5% titanium dioxide or zinc oxide. The suit must have high cooling capacity, the temperature under the suit rises after twenty seconds to 68° C., under direct action of flame, then the temperature keeps constant and the temperature quickly rises approximately after 50 seconds depending on how quickly water evaporates from the solution.

In case of soaking a veil intended for extinguishing a fire of inanimate things with the solution it is adequate to prepare the solution to a large extent of the extinguishing agent, because it is not necessary to select the cooling capacity but it is necessary to extinguish the existing fire quickly. It is convenient if a veil serving for protection of inanimate things has been soaked with a solution with the following composition: 45% of soaking agent, 50% of water and 5% of component reflecting thermal radiation. The temperature under the veil soaked with this solution rises quickly.

The firefighting water garment is manufactured in such a way that the cotton fabric shaped like a veil or as a suit is submerged into the prepared solution. After several seconds the solution penetrates into the bulk of the fabric. Thus the firefighting water garment is produced that is composed of fabric soaked with the solution and then it is enclosed into air-tight package where it can be stored for 5 years. In case of fire the package is to open, the firefighting water garment is drawn out and dressed on a person immediately, if being in the frock-like shape, or the firefighting water garment is thrown over the fire or a person, an animal or a thing, if being in the veil-like shape.

Temperature tests of the firefighting water garment pursuant to the standard ČSN EN 469:2006/A1:2007—Protective clothing for firefighters—Performance requirements for protective clothing for firefighting concerning propagation of flame, resistance to radiant heat, resistance to convection heat and thermal endurance (Articles 6.1, 6.2, 6.3 and 6.5) have been performed in the Textile Testing Institute. These parameters have been investigated: Limited propagation of Flame (Test Method ČSN EN ISO 15025), Transfer of Heat-Flame (convectional heat) (Test Method ČSN EN 367 ISO 9151), Transfer of Heat-Radiant Heat (Test Method ČSN EN 6942) and Thermal Resilience (Test Method ISO 17493). According to testing pursuant to the above standards, the firefighting water garment has been found fully adequate.

First the firefighting water garment has been subjected to temperature tests. The protective effect of the firefighting water garment against heat has been so huge that the big reflection of heat has even damaged the equipment measuring temperature. For further testing according to selected test methods, the samples of cotton fabric have been submerged in the solution of extinguishing agent only.

Test method: Limited propagation of flame has run on a square of cotton fabric in the solution of extinguishing agent with size 50×50 mm for 10 seconds. No damage on the fabric has occurred. Further the test method: Transfer of Heat—Flame has been applied, with flame action 80 kW/m$^2$, the material has passed the standard. Last but not least the test method: Transfer of Heat—Radiant Heat has been applied, with flame action 40 kW/m$^2$. The result has been satisfactory according to the standard. And finally the test method: Thermal Resilience has been applied. The test runs at a marked place with size 50×50 mm and the material is subjected to temperature 260° C. for 5 minutes. After heat action, the material, and no layer in case of multi-layer material, may neither set on fire nor melt and may not shrink by more than 5% both in longitudinal and cross directions. The result has been satisfactory according to the standard, no degradation of the sample has occurred.

According to the perfect results of the tests above, the firefighting water garment could be further tested as a sewn suit or veil. The suit has been tested pursuant to the standard ISO 13506:208, so called Fireman which determines if the suit is suitable for use as a firefighting suit. The suit, soaked with the solution, has been dressed on a dummy that has had sensors on its body and the sensors have recorded rise of temperature under the suit and have assessed whether burns due to heat exposure, if any, would be compatible with life. Twelve burners have been placed around the dummy and they have been switched on at the same time. The standard sets that the suit must withstand 8 seconds of direct action of flames, without the suit failure and without recording such readings on the sensors that would be incompatible with life. Subsequently after the burners are switched off, the suit shall stay for another 120 seconds on the dummy. Tissue injury would occur if the tissue heats and is kept at temperature above 70° C., but marked pain is felt already at temperature about 50° C. This test has passed the standards and the suit according to Example 2a has been approved as a device suitable for firefighting protection, moreover no breach of the suit has occurred.

The veils manufactured according to Examples 1c, 1b and 1a have also been subjected to laboratory testing. A veil, soaked in the solution, has been suspended on a metal structure with a temperature sensor, then a gas burner has been fired with flame temperature about 850° C. for 20 seconds. After the gas burner has been switched off, readings of the temperature sensor, placed behind the veil, have been recorded and the quality of the material has been assessed visually. The temperature under the veil has reached about 70° C. which is a temperature allowing quick evacuation from fire, moreover no breach of the fabric has occurred.

A temperature profile has been determined for the firefighting water garment according to its composition in the full utility range, as presented in the chart in FIG. 10. Thus for the solution composition A: 47.5% water, 47.5% extinguishing agent, 5% TiO2, where the high concentration of the extinguishing agent provides for the slowest temperature rise during the first 30 seconds but with subsequent steep rise of temperature caused by low concentration of water.

B: 67.5% water, 22.5% extinguishing agent, 10% TiO2, where the lower concentration of the extinguishing agent compared to the case A causes more steep temperature rise of the garment to higher temperature and its subsequent isotermic behaviour for 90 seconds caused by evaporation of big quantity of water.

C: 92% water, 2.76% extinguishing agent, 5.24% ZnO2, where the lowest concentration of the extinguishing agent causes the quickest heating of the garment and its shorter isotermic behaviour against case B because low quantity of extinguishing agent does not provide for adequate decrease of surface tension of water for maximum absorption into the fabric.

Figure 1:
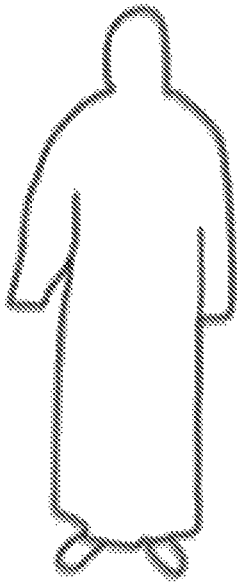
FIG. 1: Firefighting suit
Figure 2:
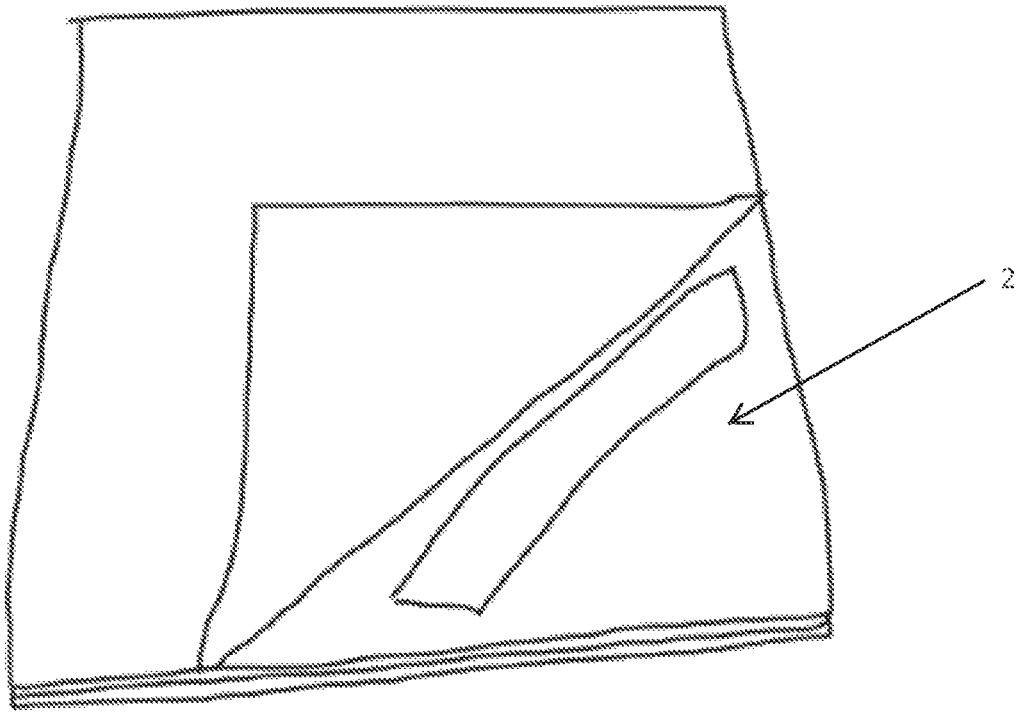
FIG. 2: Firefighting veil
Figure 3:
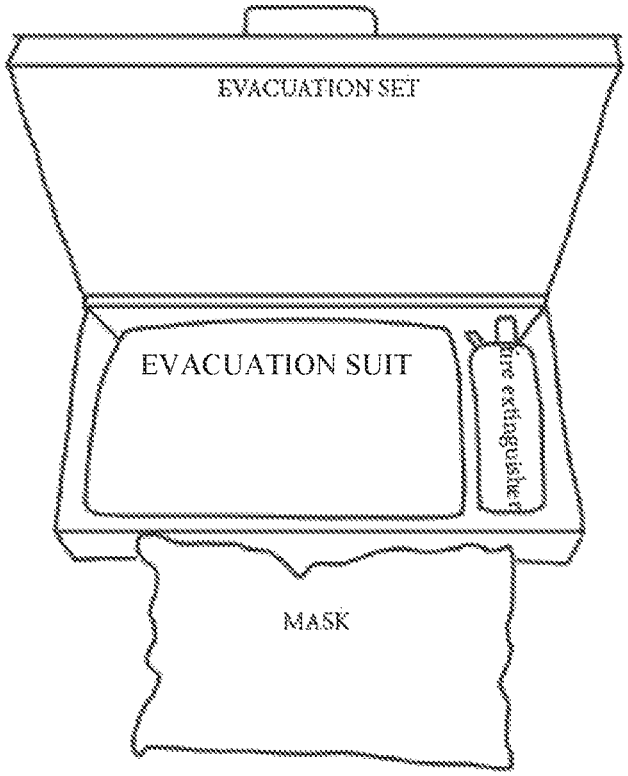
FIG. 3: Suit packed in an airtight package
Figure 4A:
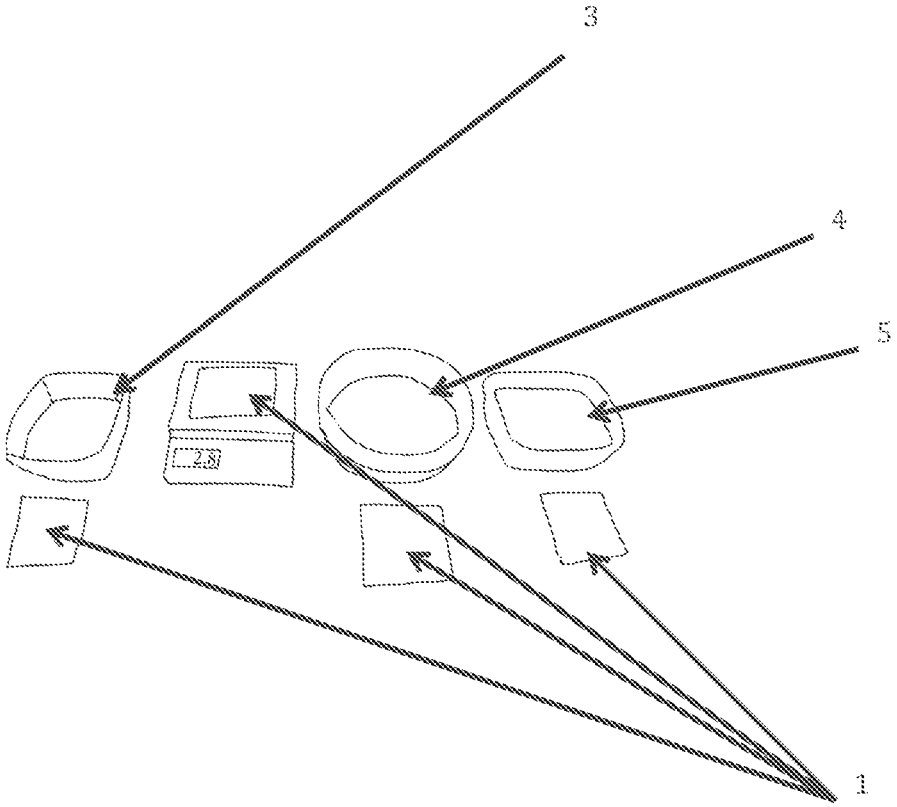
FIG. 4: Operation of solution with soaking agent a) Initial weighting of fabric b) Submerging of fabric in solution c) Final weighting of fabric
Figure 4B:
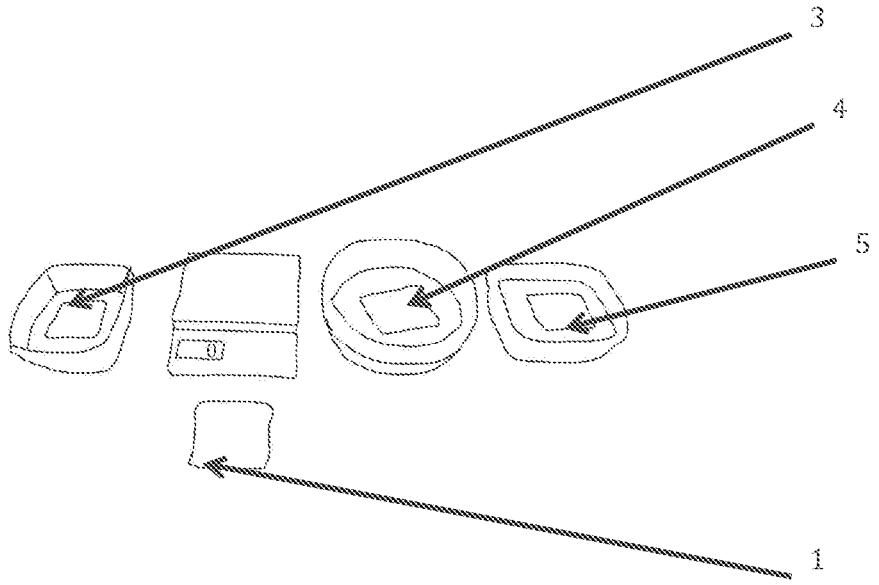
Figure 4C:
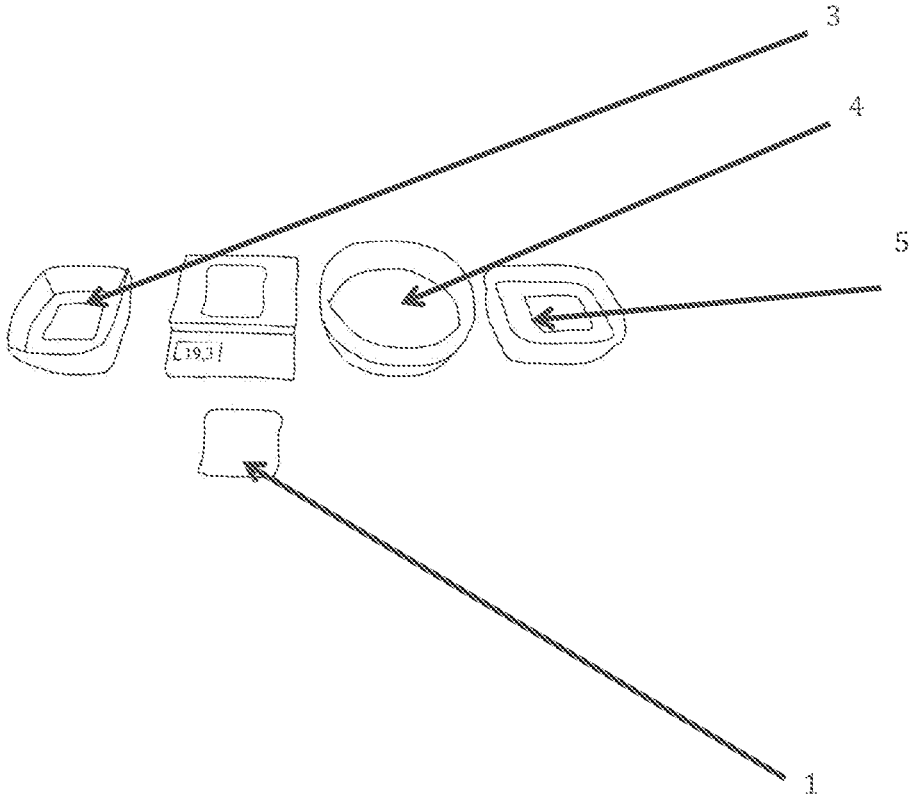
Figure 5A:
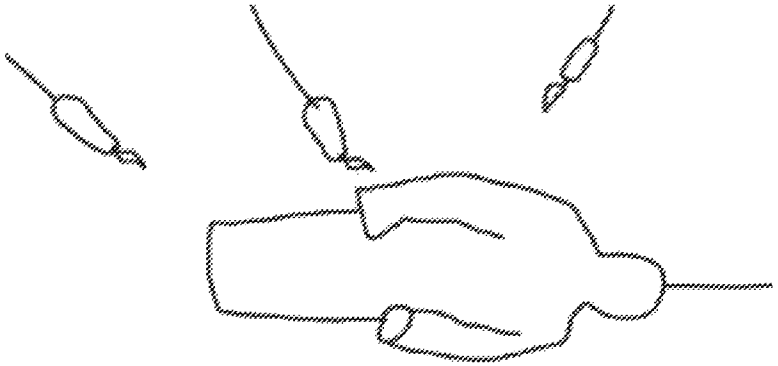
FIG. 5: Firefighting test of suit pursuant to standard ISO 13506:2008 a) Suit dressed on dummy b) Burning burners
Figure 5B:
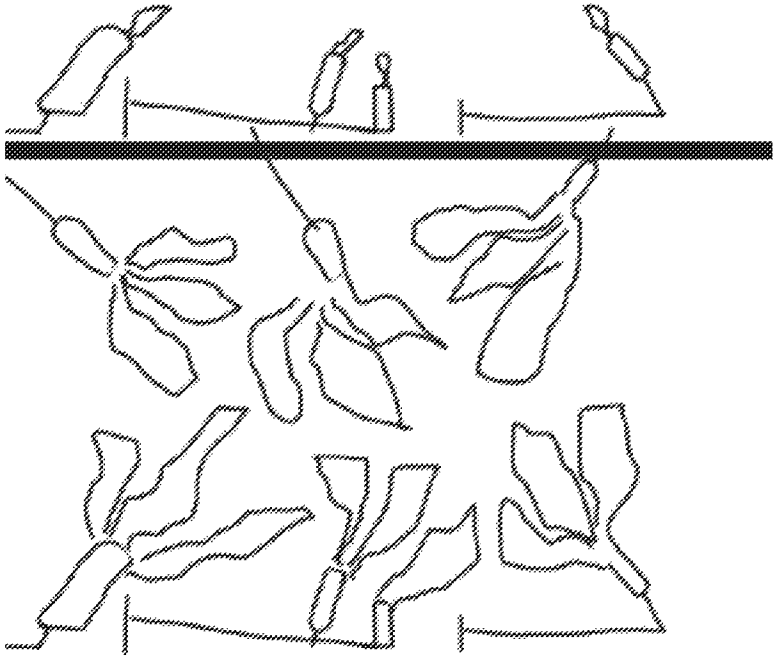
Figure 6:
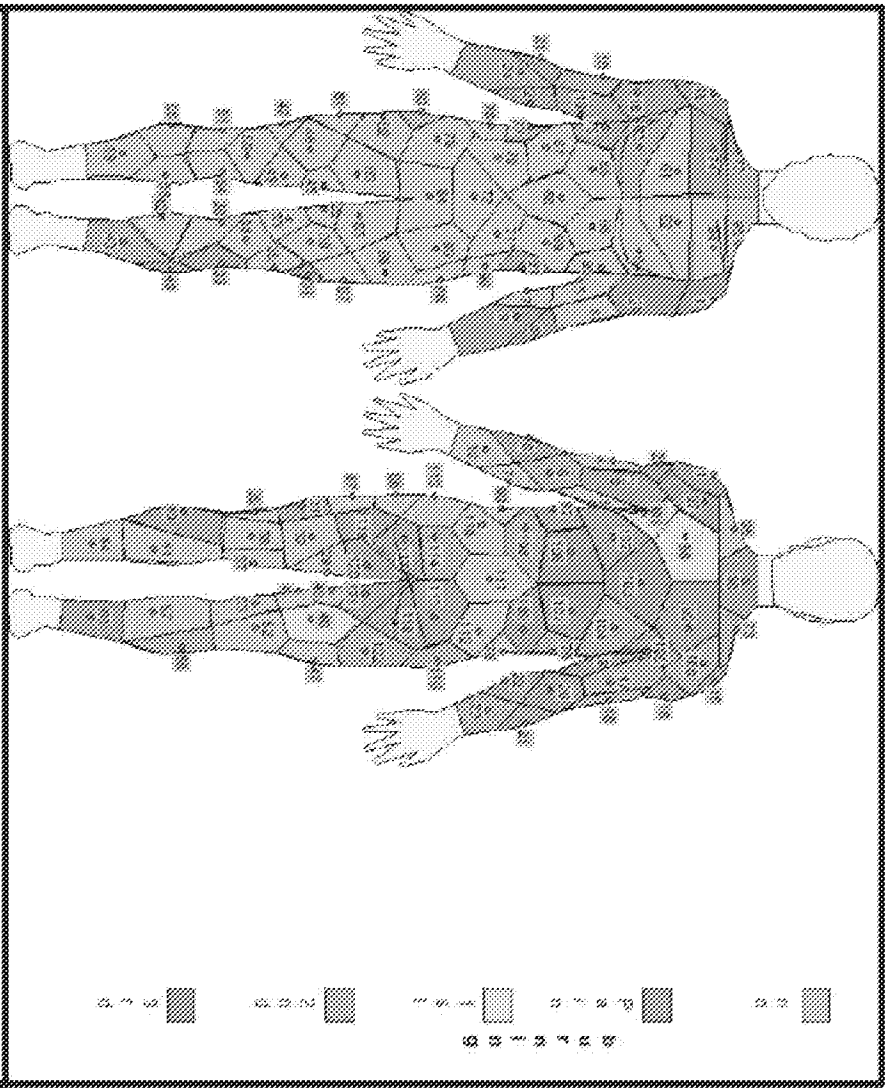
Figure 7:
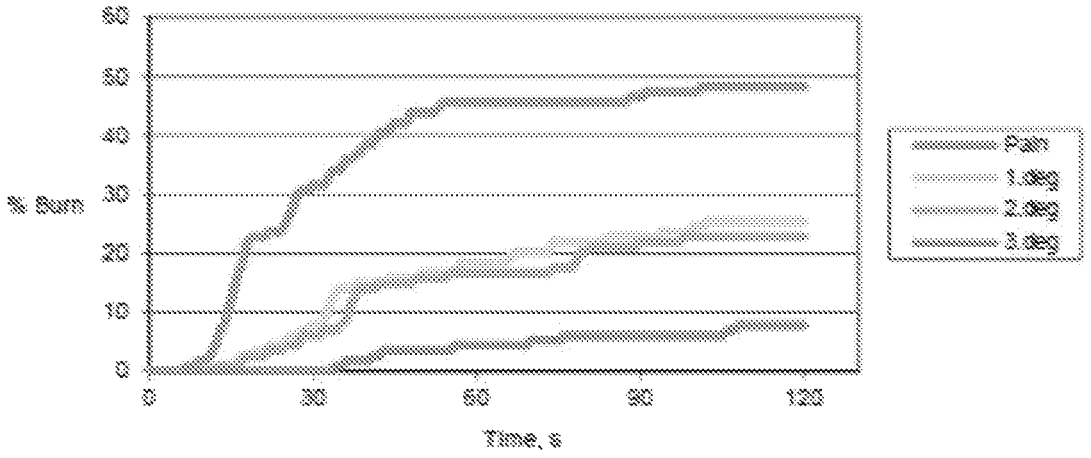
Figure 8:
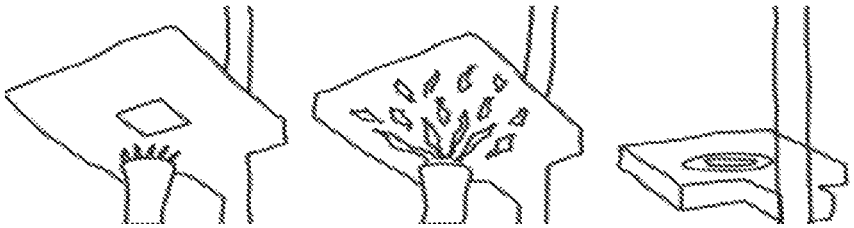
Figure 9:
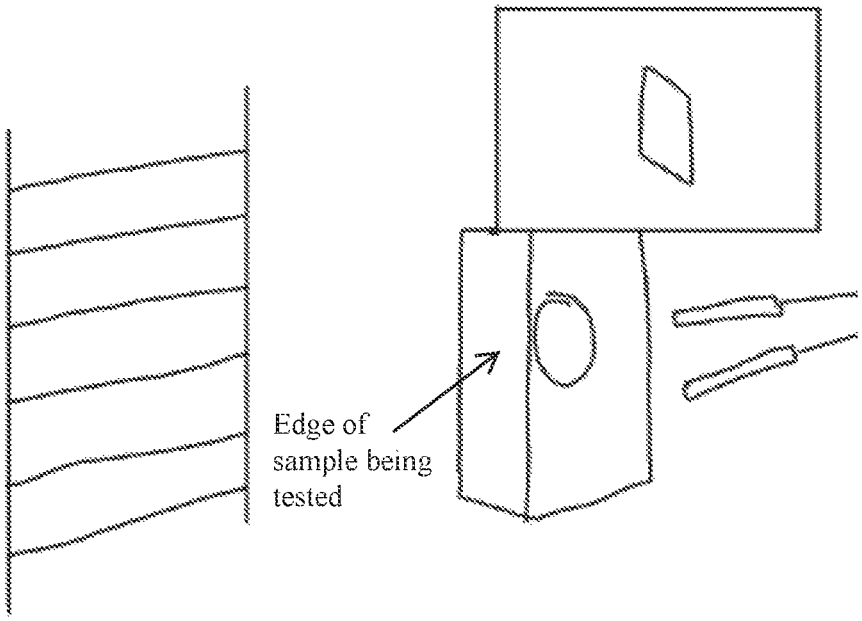
Figure 10:
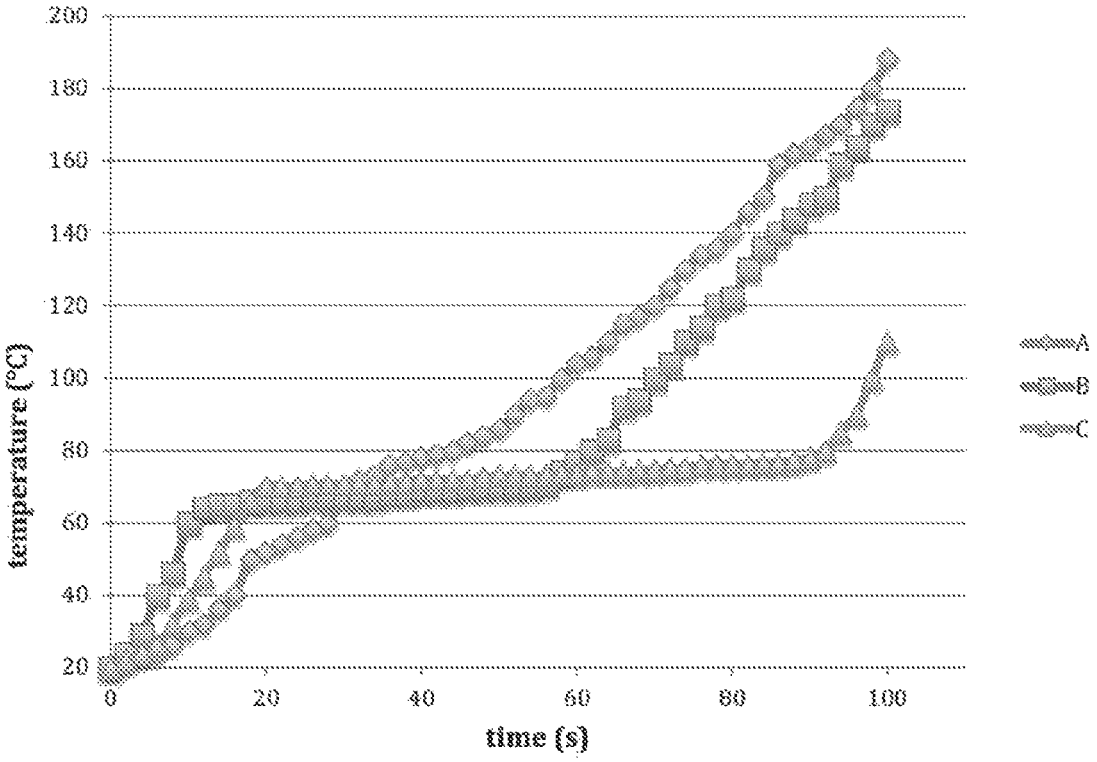

FIG. 6: Assessment of firefighting test of suit—data from sensors positioned on dummy FIG. 7: Chart of assessment of firefighting test of suit—temperature dependence of level of burn FIG. 8: Presentation of test—resilience against limited propagation of flame on square of fabric FIG. 9: Presentation of test—Long effect of radiant heat FIG. 10: Chart of time dependence of temperature presenting behaviour of fabric soaked with solutions of different composition, A: veil soaked with solution according to Example 3b: 66.67% water, 30% extinguishing agent, 3.33% $TiO_2$, B: suit soaked with solution according to Example 2a: 67.5% water, 22.5% extinguishing agent, 10% $TiO_2$, C: suit soaked with solution according to Example 2b: 92% water, 2.76% extinguishing agent, 5.24% $TiO_2$

EXAMPLES

Example 1 a) Manufacture of Fabric and Sewing of Veil with Single Weave, 2 Threads in a Single Heddle The fabric has been manufactured in a weaving loom of pure cotton yarn that has consisted of warp ends marked TEX/pk 25 1 AIBD and of filling picks marked TEX/pk 72 1 AIBD where TEX=mass of single thread with length 1000 m, pk=yarn quality, AI=quality and BD=loose end. First 4920 warp ends per a warp beam have been prepared, they have been roved in pairs between wires in the reed and they also have been inserted in pairs into each eye of a heddle, thus 2460 heddles have been placed and 2460 wires have been placed in the reed. The reed number has been 150 wires per 10 cm. The weaving process has run as follows: first all odd heddles have been raised and a filling pick has been guided through the shed using pneumatic pick. Then all even heddles have been raised and the filling pick has been picked in the opposite direction. 3000 rows of filling picks have been picked in total.

The thickness of the manufactured fabric has been approximately 0.5 mm and the area weight of the fabric in the loom-finished condition has been about 271 g/m$^2$. The raw width has been 154 cm and the reed width has been 164 cm. The strength of the warp fabric has been 340 and the strength of the weft fabric has been 918, thus the specific strength of the raw fabric has been 629. The fabric has been combed on both sides subsequently and its final area weight has been 231 g/m$^2$ and the thickness of the picked fabric has been 0.8 mm.

From the fabric prepared in this way an active cooling extinguishing and evacuation veil has been sewn with dimensions of 150×170 cm and weight 750.8 g. The veils applicable for evacuation of persons have also been fitted with strips for easier holding in corners on one side.

b) Manufacture of Fabric and Sewing of Veil, 2 Threads in Single Heddle

The fabric has been manufactured in a weaving loom of pure cotton yarn that has consisted of warp ends marked TEX/pk 25 1 AIBD and of filling picks marked TEX/pk 72 1 AIBD, where TEX=mass of single thread with length 1000 m, pk=yarn quality, AI=quality and BD=loose end. First 4920 warp ends per a warp beam have been prepared, they have been roved in pairs between wires in the reed and they also have been inserted in pairs into each eye of a heddle, thus 2460 heddles have been placed and 2460 wires have been placed in the reed. The reed number has been 150 wires per 10 cm. The weaving process has run as follows: first all odd heddles have been raised and a filling pick has been guided through the shed using pneumatic pick. Then all even heddles have been raised and the filling pick has been picked in the opposite direction. 3000 rows of filling picks have been picked in total.

The thickness of the manufactured fabric has been about 1 mm and the area weight of the fabric in the loom-finished condition has been about 406 g/m$^2$. The raw width has been 154 cm and the reed width has been 164 cm. The strength of the warp fabric has been 340 and the strength of the weft fabric has been 918, thus the specific strength of the raw fabric has been 629.

The fabric has been combed on both sides subsequently and its final area weight has been 346 g/m$^2$ and the thickness of the picked fabric has been 1.6 mm. An active cooling extinguishing and evacuation veil with dimensions 150×140 cm and weight 550.8 g has been sewn of this way manufactured fabric.

c) Manufacture of the Fabric and Sewing of Two-Layered Veil for Extreme Use with Doubled Weft Weave, 1 Thread in 1 Heddle The fabric has been manufactured in a weaving loom of pure cotton yarn that has consisted of warp ends marked TEX/pk 25 1 AIBD and of filling picks marked TEX/pk 72 1 AIBD, where TEX=mass of single thread with length 1000 m, pk=yarn quality, AI=quality and BD=loose end. First 4920 warp ends per a warp beam have been prepared, they have been roved in pairs between wires in the reed and one thread has been inserted in each hole in the heddles, thus 4920 heddles have been used and 2460 wires have been placed in the reed. The reed number has been 150 wires per 10 cm. The weaving process has run as follows: first all odd heddles have been raised and two filling picks have been guided through the shed using pneumatic pick. Then all even heddles have been raised and the filling picks have been picked in the opposite direction. 3000 rows of filling picks have been picked in total, two in each shed. The fabric with doubled weft weave has been manufactured, with thickness about 1 mm and its area weight in the loom-finished condition has been 406 g/m$^2$. The raw width has been 154 cm and the reed width has been 164 cm. The strength of the warp fabric has been 340 and the strength of the weft fabric has been 918, thus the specific strength of the raw fabric has been 629. The fabric has been combed on both sides subsequently and its final area weight has been 346 g/m$^2$ and the thickness of the picked fabric has been 1.6 mm.

From the fabric thus prepared, an active cooling extinguishing and evacuation veil has been sewn by sewing through two layers laying one on another with dimensions 150×180 cm. The final weight of the through-sewn two-layer veil has been 1550.8 g. Moreover the veil has been fitted with strips for easier holding in corners on one side, the final area weight of the sewn-through veil has been 630 g/m$^2$ and the thickness has been 2.9 mm.

d) Manufacture of Fabric and Sewing of Suit for Professional Firemen with Doubled Filling Pick, 2 Threads in Single Heddle The fabric has been manufactured in a weaving loom of pure cotton yarn that has consisted of warp ends marked TEX/pk 25 1 AIBD and of filling picks marked TEX/pk 72 1 AIBD, where TEX=mass of single thread with length 1000 m, pk=yarn quality, AI=quality and BD=loose end. First 4920 warp ends per a warp beam have been prepared, they have been roved in pairs between wires in the reed and they also have been inserted in pairs into each eye of a heddle, thus 2460 heddles have been placed and 2460 wires have been placed in the reed. The reed number has been 150 wires per 10 cm. The weaving process has run as follows: first all odd heddles have been raised and two filling picks have been guided through the shed using pneumatic pick. Then all even heddles have been raised and filling picks have been picked in the opposite direction. 3000 rows of filling picks have been picked in total two in each shed. The fabric with doubled weft and warp weave has been manufactured with thickness 1 mm and its area weight in the raw condition has been 406 g/m$^2$. The raw width has been 154 cm and the reed width has been 164 cm. The strength of the warp fabric has been 340 and the strength of the weft fabric has been 918, thus the specific strength of the raw fabric has been 629.

The thickness of the manufactured fabric has been about 1 mm and the area weight of the fabric in the loom-finished condition has been about 406 g/m$^2$. The raw width has been 154 cm and the reed width has been 164 cm. The strength of the warp fabric has been 340 and the strength of the weft fabric has been 918, thus the specific strength of the raw fabric has been 629. The fabric has been combed on both sides subsequently and its final area weight has been 346 g/m$^2$ and the thickness of the picked fabric has been 1.6 mm.

A firefighting suit has been sewn of the fabric shaped like a frock with a hood fitted with velcro strips with weight 1100 g and area 3.18 m$^2$ with area weight 346 g/m$^2$.

e) Manufacture of Fabric and Sewing of Suit with Doubled Weft Weave, 1 Thread in 1 Heddle The fabric has been manufactured in a weaving loom of pure cotton yarn that has consisted of warp ends marked TEX/pk 25 1 AIBD and of filling picks marked TEX/pk 72 1 AIBD, where TEX=mass of single thread with length 1000 m, pk=yarn quality, AI=quality and BD=loose end. First 4920 warp ends have been prepared, in two rows one above another in two warp beams, 2460 warp ends have been in each beam. They have been roved in pairs between wires in the reed and they have been inserted one by one into each eye of a heddle, thus 4920 heddles have been placed and 2460 wires have been placed in the reed. The reed number has been 150 wires per 10 cm. The weaving process has run as follows: first all odd heddles have been raised and two filling picks have been guided through the shed using pneumatic pick. Then all even heddles have been raised and filling picks have been picked in the opposite direction. 3000 rows of filling picks have been picked in total, two in each shed. The fabric with doubled weft weave has been manufactured with thickness about 1 mm and its area weight in the loom-finished condition has been 406 g/m$^2$. The raw width has been 154 cm and the reed width has been 164 cm. The strength of the warp fabric has been 340 and the strength of the weft fabric has been 918, thus the specific strength of the raw fabric has been 629. The fabric has been combed on both sides subsequently and its final area weight has been 346 g/m$^2$ and the thickness of the picked fabric has been 1.6 mm. A firefighting suit has been sewn of the fabric shaped like a frock with a hood fitted with velcro strips with weight 1100 g and area 3.18 m$^2$ with area weight 346 g/m$^2$.

Example 2 a) Preparation of Solution and Impregnation of Suit: 67.5% Water, 22.5% Extinguishing Agent, 10% $TiO_2$ 10.125 litres of water was poured into a clean vessel with capacity of 15 litres, 3.375 litres of extinguishing agent FireAde 2000 has been added in water. 1.5 kg of powder titanium dioxide marked Pretiox R200M of mineral rutile containing 99% of $TiO_2$ and with density of 4.2 g/cm$^3$ has been poured in the solution of water and of extinguishing agent under permanent stirring. The solution has been manually stirred for 4 minutes till it homogenized.

The suit shaped like a frock, manufactured of the fabric according to Example 1e has been submerged into the solution prepared for the period of 2 minutes, so that the solution would enter into the suit bulk. After this period has passed, the suit has been taken out from the vessel and it has been enclosed into air-tight package which has been a solid plastic bag fitted with a layer preventing penetration of sun radiation. The suit has soaked 6.482 litres of the solution which amounts to 2.038 litres of the solution per 1 $m^2$ of the fabric, therefore the suit has had a wall of water 2 mm thick available.

b) Preparation of Solution and Impregnation of Suit for Professional Firemen: 92% Water, 2.76% Extinguishing Agent, 5.24% $ZnO_2$ 13.8 litres of water has been poured into a clean vessel with capacity of 15 litres, 0.414 litres of extinguishing agent Fomtec has been added in water. 0.786 kg of powder zinc oxide containing 99% of $ZnO_2$ and with density of 5.62 g/$cm^3$ has been poured in the solution of water and of extinguishing agent under permanent stirring. The solution has been manually stirred for 2 minutes till it homogenized.

The suit shaped like a frock, manufactured of the fabric according to Example 1d has been submerged into the prepared solution for 2 minutes, so that the solution would enter into the suit bulk. After this time has passed, the suit has been taken out from the vessel and it has been enclosed into air-tight package which has been a solid plastic bag fitted with a layer preventing penetration of sun radiation. The suit has soaked 5.936 litres of the solution which amounts to 1.86 litres of the solution per 1 $m^2$ of the fabric, therefore the suit has had a wall of water 2 mm thick available.

Example 3 a) Preparation of Solution and Impregnation of Veil Particularly for Evacuation Purposes: 66.67% Water, 30% Extinguishing Agent, 3.33% $TiO_2$ 10 litres of water has been poured into a clean vessel with capacity of 15 litres, 4.5 litres of extinguishing agent FireAde 2000 has been added in water. 0.5 kg of powder titanium dioxide marked Pretiox R200M of mineral rutile containing 99% of $TiO_2$ and with density 4.2 g/$cm^3$ has been poured in the solution of water and of extinguishing agent under permanent stirring. The solution has been manually stirred for 2 minutes till it homogenized.

An active cooling extinguishing and evacuation veil with dimensions 150×170 cm prepared according to Example 1a, fitted with handles in corners on one side for easier holding, has been submerged into the prepared solution for 2 minutes, so that the solution would enter into the veil bulk. After this time has passed, the veil has been taken out from the vessel and has been enclosed into air-tight package which has been a solid plastic bag fitted with a layer preventing penetration of sun radiation. The veil has soaked 2.212 litres of the solution which amounts to 0.867 litres of the solution per 1 $m^2$ of the fabric, therefore the veil has had a wall of water 1 mm thick available.

b) Preparation of Solution and Impregnation of Veil Particularly to Extinguish Raising Fires: 47.5% Water, 47.5% Extinguishing Agent, 5% $TiO_2$ 7.125 litres of water has been poured into a clean vessel with capacity of 15 litres, 7.125 litres of extinguishing agent Fomtec has been added in water. 0.75 kg of powder titanium dioxide marked Pretiox R200M of mineral rutile containing 99% of $TiO_2$ and with density 4.2 g/$cm^3$ has been poured in the solution of water and of extinguishing agent under permanent stirring. The solution has been manually stirred for 2 minutes till it homogenized.

An active cooling extinguishing veil with dimensions 150×140 cm prepared according to Example 1b, fitted with handles on one narrower side for easier holding has been submerged into the prepared solution for 2 minutes, so that the solution would enter into the veil bulk. After this time has passed, the veil has been taken out from the vessel and has been enclosed into air-tight package, which has been a solid plastic bag fitted with a layer preventing penetration of sun radiation. The veil has soaked 3.246 litres of the solution, which amounts to 1.546 litres of the solution per 1 $m^2$ of the fabric, therefore the veil has had a wall of water 2 mm thick available.

c) Preparation of Solution and Impregnation of Veil for Heavy Duty in Industrial Objects: 76.5% Water, 13.15% Extinguishing Agent, 10% $TiO_2$ 11.475 litres of water has been poured into a clean vessel with capacity of 15 litres, 2.025 litres of extinguishing agent FireAde 2000 has been added in water. 1.5 kg of powder zinc oxide containing 99% of $ZnO_2$ and with density 5.62 g/$cm^3$ has been poured in the solution of water and of extinguishing agent under permanent stirring. The solution has been manually stirred for 3 minutes till it homogenized.

An active cooling extinguishing and evacuation veil according to Example 1c has been submerged into the prepared solution for 4 minutes, so that the solution would enter into the veil bulk. After this time has passed, the veil has been taken out from the vessel and has been enclosed into air-tight package, which has been a solid plastic bag fitted with a layer preventing penetration of sun radiation. The veil has soaked 6.8545 litres of the solution, which amounts to 2.539 litres of the solution per 1 $m^2$ of the fabric, therefore the veil has had a wall of water 3 mm thick available.

Example 4

Test to Compare Soaking of Solutions into Fabric

Three vessels have been prepared, 200 ml of solution of water with Jar in ratio 1/3, thus one part of Jar and two parts of water, have been poured in the first vessel, 200 ml of solution with extinguishing agent FireAde 2000 and with titanium dioxide in ratio 1/3 thus one part of extinguishing agent and two parts of water and 5 g of titanium dioxide has been poured in the second vessel and 200 ml of pure water has been poured in the third vessel. The fabric manufactured according to Example 1d with dimensions 9×9 cm and with weight 2.8 g has been inserted into each vessel. The fabric has been immediately submerged in the first two solutions and it has soaked with them. In the third vessel, with water, the fabric has kept at the surface and it has not submerged, even under mechanic assistance. After 20 seconds of exposure in the vessels, the fabric has been taken out and weighted. The fabric taken out from water has weighted 5 g, the fabric taken out from the solution with soaking agent FireAde 2000 has weighted 19.3 g and the fabric taken out from water with Jar has weighted 13.4 g. This test has documented near incapability of water without soaking agent to soak into the fabric and 5 times increase of absorption of water with Jar and 7.5 times increase of absorption of water with FireAde 2000.

Example 5

Test of Firefighting Resilience of Suit—Fireman a) The firefighting water garment shaped like a firefighting suit and manufactured according to Example 2a has been subjected to a temperature test pursuant to standard ISO 13506:208. The firefighting suit has been dressed on a dummy and 135 sensors have been placed on its body, the sensors assess what amount of heat has passed through the suit and how extensive burns would occur, if any. 12 burners have been positioned around the dummy, in two rows six in each side. Six of them concentrated on the legs and body and the remaining 6 burners concentrated on the upper part of the body and the head. The test has run for 128 s, and the heat flow of burners has risen to 84 $kW/m^2$ and temperature has been approximately 1200° C. The burners have been on for the period of 8 seconds. After the burners have been switched off, vapour has been visible, and it has evaporated gradually from the firefighting suit. The suit has stayed on the dummy for other 120 seconds. The suit has been checked after the test has finished, it has shown no impairment and no roasting of the fabric. The test has been performed three times in total.

Then assessment of data from the sensors and averaging data from all the three tests have followed. After 120 seconds, incidence of pain has been registered in 23.7%, caused in 1.8% by first degree burns and in 22.8% by second and third degree burns in the area of back and chest. In our case, these have been rather scalds than burns. According to the standard, the assessment has been evaluated as compliant and the firefighting suit has been assessed as suitable for use as the firefighting means.

b) The firefighting water garment shaped like a firefighting suit and manufactured according to Example 2a has been subjected to the temperature test pursuant to the standard ISO 13506:208. The firefighting suit has been dressed on a dummy and 135 sensors have been placed on its body, the sensors assess what amount of heat has passed through the suit and how extensive burns would be, if any. 12 burners have been positioned around the dummy, in two rows six each. Six of them concentrated on the legs and body, and the remaining 6 burners concentrated on the upper part of the body and the head. The test has run for 120 s, and the heat flow of burners has risen to 84 $kW/m^2$ and temperature has been approximately 1200° C. The burners have been several times on for 8 seconds. After the burners have been switched off, vapour has been visible, and it has evaporated gradually from the firefighting suit. The suit has been checked after the test has finished, it has shown no impairment and no roasting of the fabric. The test has been performed three times in total.

Then assessment of data from the sensors and averaging data from all the three tests have followed. After 120 seconds, incidence of pain has been registered in 29%, caused in 5.3% by first degree burns and in 25% by second and third degree burns in the area of back and chest. In our case, these have been rather scalds than burns. According to the standard, the assessment has been evaluated as compliant and the firefighting suit has been assessed as suitable for use as the firefighting means.

Example 6

Test on Firefighting Resilience of Veil a) A firefighting veil sewn of the fabric according to Example 1b, and soaked with the solution prepared according to Example 3a, has been subjected to a temperature test. The veil has been pulled over a metal structure and a temperature sensor has been placed on the structure. A temperature burner has been positioned opposite to the veil and its temperature has been registered by another temperature sensor, positioned on the other side of the veil. The temperature burner has run for 20 seconds and then it has been switched off. The temperature of the flame has achieved 1000° C. The first sensor, positioned under the fabric, has registered temperature 73° C., without the fabric being impaired.

b) A firefighting veil sewn of the fabric according to Example 1b, and soaked with the solution prepared according to Example 3b, has been subjected to a temperature test. The veil has been pulled over a metal structure, on which a temperature sensor has been placed. A temperature burner has been positioned opposite to the veil and its temperature has been registered by another temperature sensor, positioned on the other side of the veil. The temperature burner has run for 20 seconds and then it has been switched off. The temperature of the flame has achieved 1000° C. The first sensor, positioned under the fabric, has registered temperature 70° C., without the fabric being impaired.

c) A firefighting veil sewn of the fabric according to Example 1a, and soaked with the solution prepared according to Example 3c, has been subjected to a temperature test. The veil has been pulled over a metal structure, on which a temperature sensor has been placed. A temperature burner has been positioned opposite to the veil and its temperature has been registered by another temperature sensor, positioned on the other side of the veil. The temperature burner has run for 20 seconds and then it has been switched off. The temperature of the flame has achieved 1000° C. after 10 seconds. The first sensor, positioned under the fabric, has registered temperature 68° C., without the fabric being impaired.

Example 7

Test on Firefighting Resilience of Veil Manufactured According to Example 3b and Suits Manufactured According to Examples 2a and 2b Outdoor The veil manufactured according to Example 3b, the suit manufactured according to Example 2a and the suit manufactured according to Example 2b have been subjected to a temperature test under direct action of flame. The veil and the suit have been pulled on a metal structure positioned outdoor. Gas burners with flame temperature 1100° C. have been placed opposite to the applied veil and suits. Temperature sensors have been positioned under the fabric to record temperature under the fabric. With a stop-watch on, the temperature on temperature sensors has been automatically recorded each 2 seconds, and the initial test temperature has been 20° C. The test has run for the period of 100 seconds in total. The temperature on temperature sensors has been put into graphs and assessed. The results of the test are presented in FIG. 10.

At the test start, the lowest temperature has been under the veil manufactured according to Example 3b. After 20 seconds of the test, the temperature sensor has registered temperature 50° C., and then the temperature has started to rise steeply and after 60 seconds the temperature reached 100° C.

At the test start, the temperature under the suit manufactured according to Example 2a has risen quickly to 68° C. and has kept constant for approximately 40 seconds, then the temperature has started to rise steeply.

The temperature under the suit manufactured according to Example 2b has risen to 70° C. after 20 seconds and has kept constant for 70 seconds, and then the temperature has started to rise steeply.

INDEX LIST

1 fabric
2 strap
3 vessel with pure water
4 vessel with water solution with extinguishing agent and titanium dioxide
5 vessel with water solution with Jar

UTILITY OF PATENT

Firefighting means distinguished by high quality protection of persons and animals in case of fire.

What is claimed is:

1. A firefighting water garment characterised by the fact that it consists of a cotton fabric soaked with a solution for the firefighting water garment where the cotton fabric with combing has a area weight of 100 to 500 g/m$^2$ and the suspension consists of at least 50% of water, 2.7 to 50% of a water soluble soaking agent and 1 to 10% of titanium dioxide or zinc oxide where each 1 m$^2$ of the fabric is soaked with at least 300 ml of the suspension.

2. The firefighting water garment according to claim 1 characterised by the fact that the cotton fabric has an area weight from 300 to 400 g/m$^2$.

3. The firefighting water garment according to claim 1 characterised by the fact that the cotton fabric has been combed.

4. The firefighting water garment according to claims 2 and 3 characterised by the fact that it consists of the cotton fabric with combing with an area weight from 330 to 370 g/m$^2$.

5. The firefighting water garment according to claims 2 and 3 characterised by the fact that each 1 m$^2$ of the fabric is soaked with at least 1 l of the suspension.

6. The firefighting water garment according to claim 1 characterised by the fact that the water soluble soaking agent is any extinguishing agent or surfactant.

7. The firefighting water garment according to claim 1 characterised by the fact that the extinguishing agent is a mixture of hydro-carbons and fluorated surface active substances of a AFFF range.

8. The firefighting water garment according to claim 1 characterised by the fact that 1 m$^2$ of the fabric is soaked with at least 2 l of the suspension.

9. The firefighting water garment according to claim 1 characterised by the fact that the solution for the firefighting water garment consists of at least 60% of water, at least 20% of soaking agent, and at least 5% of titanium dioxide or zinc oxide.

10. The firefighting water garment according to claim 1 characterised by the fact that the solution for the firefighting water garment consists of 92% of water, 3% of soaking agent and 5% of titanium dioxide or zinc oxide.

11. The firefighting water garment according to claim 1 characterised by the fact that the solution for the firefighting water garment consists of 50% of water, 45% of soaking agent and 5% of titanium dioxide or zinc oxide.

12. The firefighting water garment according to claim 1 characterised by the fact that the fabric consists of warp ends marked TEX/pk 25 1 AIBD and of doubled weft threads marked TEX/pk 72 1 AIBD.

13. The firefighting water garment according to claim 1 characterised by the fact that it is shaped like a frock.

14. The firefighting water garment according to claim 1 characterised by the fact that it is a veil with straps.

15. The firefighting water garment according to claim 1 characterised by the fact that it consists of two layers of the cotton fabric with combing soaked with the solution for the firefighting water garment.

16. Utilisation of the firefighting water garment according to claim 1 for an evacuation from a life-threatening fire.

* * * * *